US005137264A

United States Patent [19]

Cloutier et al.

[11] Patent Number: 5,137,264

[45] Date of Patent: Aug. 11, 1992

[54] SELF-ACTUATED BOOK SECTION FEEDER

[75] Inventors: Jean G. Cloutier, Ste Urusule; Marcel Cloutier, Louiseville, both of Canada

[73] Assignee: Atelier D'Usinage Cloutier Inc., Louiseville, Quebec, Canada

[21] Appl. No.: 730,753

[22] Filed: Jul. 16, 1991

[51] Int. Cl.[5] ..... B65H 41/00

[52] U.S. Cl. ..... 270/52; 270/53; 270/54; 270/58; 271/265

[58] Field of Search ..... 270/53, 54, 55, 57, 270/58, 52; 271/265, 266, 150, 157

[56] References Cited

U.S. PATENT DOCUMENTS 3,718,217 2/1973 Stobb ..... 270/54
3,804,404 4/1974 Bosshard .
3,806,111 4/1974 Lachmann ..... 270/54
3,816,866 6/1974 Miaskoff et al. .
4,564,186 1/1986 Clarke, Jr. ..... 270/54
4,621,757 11/1986 Osako .
4,639,177 1/1987 Meratti .
4,767,250 8/1988 Garlichs .
4,844,433 7/1989 Hashe ..... 270/54
4,867,432 9/1989 Matta ..... 270/54
4,904,138 2/1990 Champeaux et al. .
4,981,292 1/1991 Cosgrove ..... 270/54

*Primary Examiner*—Edward K. Look
*Assistant Examiner*—Therese M. Newholm
*Attorney, Agent, or Firm*—Edwin E. Greigg; Ronald E. Greigg

[57] ABSTRACT

A self-actuated book section feeder for use to feed automatically book sections to an apparatus for binding these sections together. This feeder comprises a table; a continuous conveyor mounted on the table; a motor secured to the table for driving the conveyor; and a detector mounted on the table and connected to the motor via a relay for actuating and stopping the motor. In use, the detector senses the presence or absence of book sections at the delivering end of the conveyor, and then automatically actuate or stop the continuous conveyor to bring more book sections.

5 Claims, 5 Drawing Sheets

SELF-ACTUATED BOOK SECTION FEEDER

BACKGROUND OF THE INVENTION

1. Field of the invention

This invention relates to a self-actuated book section feeder. Particularly, the invention relates to a feeder that automatically senses and regulates the feeding of book sections to a book binding apparatus.

2. Description of the prior art Many devices have been described that regulate the thickness of a book to be bound. Amongst others, U.S. Pat. No 4,904,138, dated Feb. 27, 1990, as invented by CHAMPEAUX et al. discloses a sensor to sense the thickness of a set of pages placed on the carriage of a binding machine. A regulating unit is provided for modifying the speed of the motor in response to an output signal from the sensor.

U.S. Pat. No. 4,767,250, dated Aug. 30, 1988, as invented by GARLICHS, discloses an external electronic measuring apparatus for determining the thickness of sample book block.

U.S. Pat. No. 4,639,177, dated Jan. 27, 1987, as invented by MERATTI, discloses a book sewing machine with automatic separation of books. An operating cycle of the separator device is started each time a control circuit is given an enabling signal by a device detecting the plane of separation between two books.

U.S. Pat. No. 4,621,757, dated Nov. 11, 1986, as invented by OSAKO, discloses means to discriminate a signature set of abnormal thickness.

U.S. Pat. No. 3,816,866, dated Jun. 18, 1974, as invented by MIASKOFF et al., discloses a detector for detecting a malfunction in a first cover feed assembly. The detector is capable of detecting either a failure to feed a cover or the feeding of double covers.

U.S. Pat. No. 3,804,404, dated Apr. 16, 1974, as invented by BOSSHARD, discloses a means to scan sheets of a book block segment for a triggering characteristic present only once in a series. Upon detection of this characteristic, a control signal is originated for controlling the operation of a book binding machine.

However, none of the above-mentioned apparatuses is designed to feed automatically a series of book sections to a book binding machine while a detector continuously senses the presence or absence of book sections, thus actuating the conveyor belt to deliver more sections to the book binding machine.

SUMMARY OF THE INVENTION

In accordance with the invention, there is provided a self-actuated book section feeder comprising: a continuous conveyor having a receiving end and a delivering end, a motor for driving the conveyor, a detector connected to the motor for actuating and stopping the motor, this detector sensing the presence or absence of book sections on the delivering end of the conveyor. This detector automatically stops the conveyor in the presence of a book section, and actuates the conveyor in the absence of book sections.

The invention is also directed to a method for automatically feeding book sections from a conveyor having a delivering end to an apparatus for binding these sections together, this method comprising the steps of: feeding book sections by the delivering end to the apparatus for binding book sections, continuously detecting the presence or absence of book sections at the delivering end of the conveyor, actuating the conveyor in response to the absence of book sections, and stopping the conveyor in response to the presence of book sections.

BRIEF DESCRIPTION OF THE DRAWINGS

Referring now to the drawings which illustrate examples of embodiments of the invention.

DETAILED DESCRIPTION OF PREFERRED EMBODIMENTS

Figure 1:
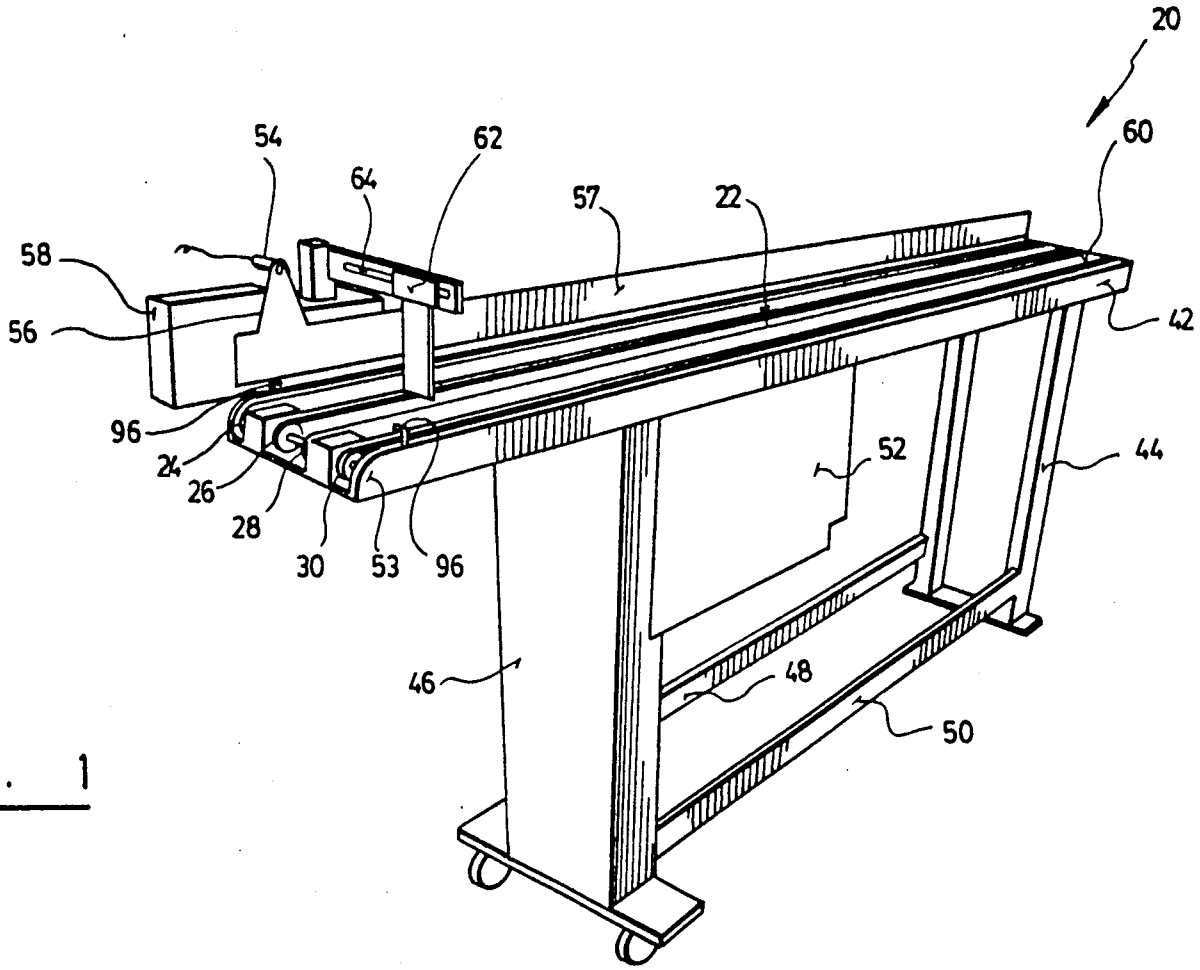
FIG. 1 is a perspective view of a book section feeder according to the invention.
Figure 3:
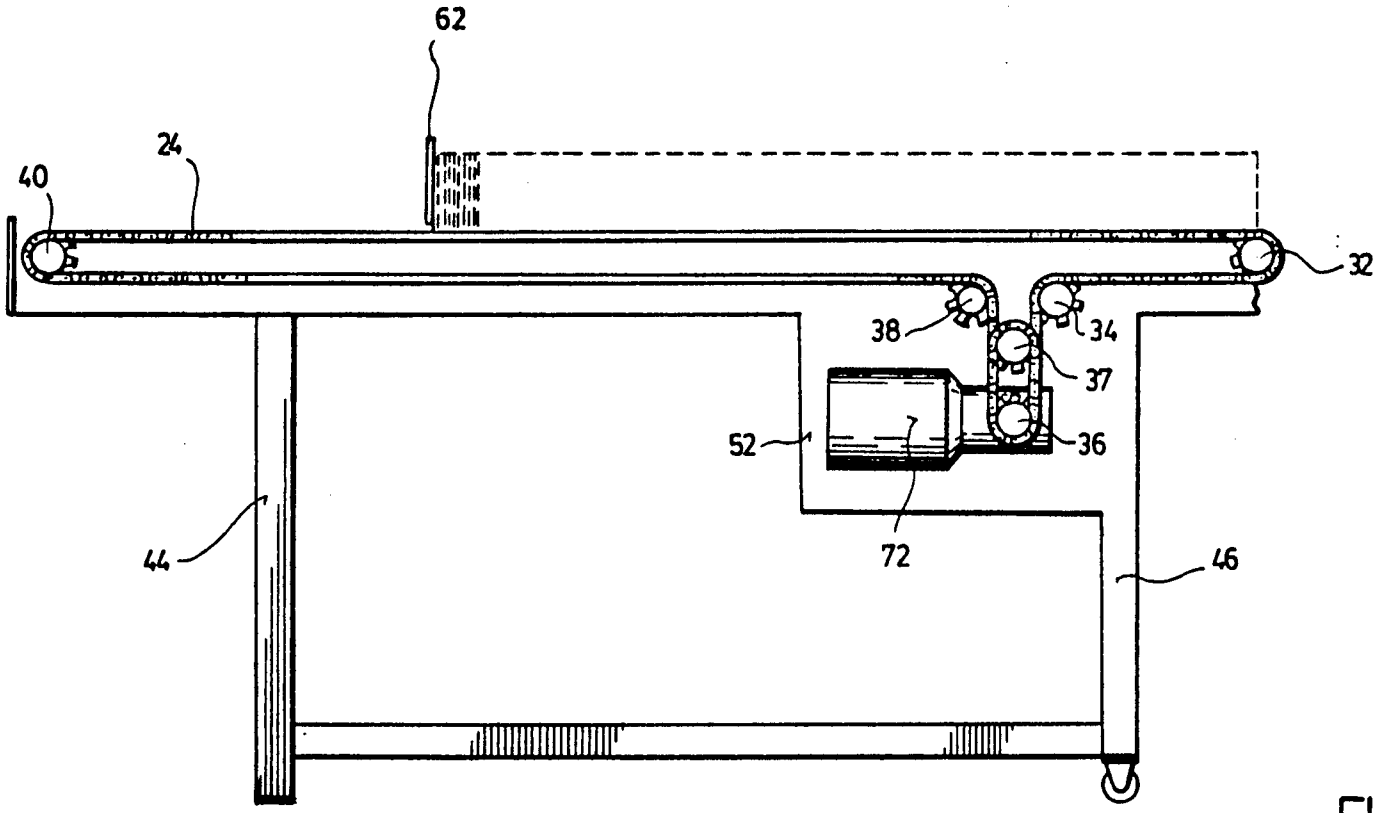
FIG. 3 is a cross-section view of the side of the book section feeder when taken along line III—III of FIG. 2.

Referring now to FIG. 1, the automatic book section feeder 20 comprises a conveyor 22. In a preferred embodiment, the conveyor 22 consist of four parallel chains 24, 26, 28, and 30 running in pairs by means of sprocket gears 32, 34, 36, 38, and 40 (as shown in FIG. 3).

The conveyor 22 is preferably mounted on a table 42 having supporting legs 44, 46 and reinforcing bars 48, 50. The conveyor 22 is driven by a motor 88 contained in a housing 52 itself connected to a worm gear speed reducer 90 such as for instance a FLEXALINE right angle worm gear speed reducer. Preferably, the motor is conveniently connected to a speed motor master PM.

Figure 5:
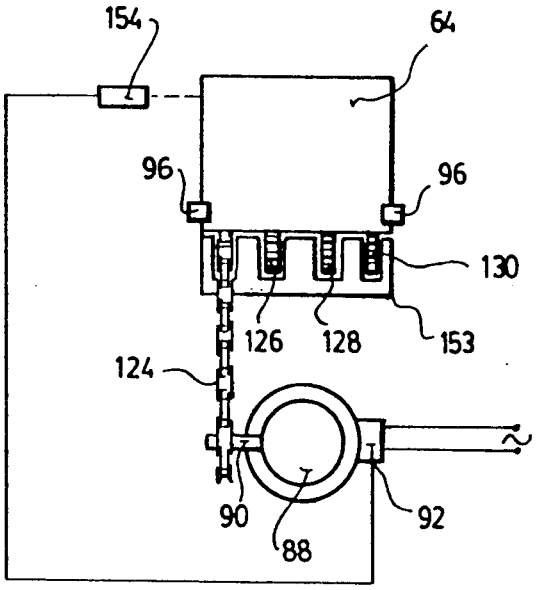
FIG. 5 is a front view of the delivering end of the book section feeder illustrating its relationship with the motor.

A detector 54 (preferably a photoelectric cell) is mounted on a bracket 56, itself mounted on the side 57 of the conveyor 22 near its delivering end 53. The detector 54 is supplied by a light source 58, and is connected to a relay 92 contained in the housing 52. The relay 92 as shown in FIG. 5 is itself connected to the motor 88. The detector 54 is adjusted to a height corresponding substantially to the upper margin 76 of the book sections fed on the conveyor 22, thereby being capable of detecting the absence of book sections when they are tilted.

Book sections 64 are placed upwardly on the conveyor 22 and held in that position at the delivering end 53 of the conveyor by retaining means 96. When pulled from a book binding apparatus, the lower margin of the book sections is slipped between the retaining means 96 and the delivering end of the conveyor 53.

The absence of book sections, when detected by the detector 54, will actuate the motor, that will in turn drive the conveyor 22 in order to carry the row of book sections 64 toward the delivering end 53, thus replacing the upper margins 76 of the sections in a vertical position. The detector 54 will then detect the presence of these sections and will stop the motor.

The feeder 20 is also provided with means to secure the book sections near or at the receiving end 60 thereof. These securing means consist preferentially of an arm 62 advancing along with the conveyor 22 as the sections are conveyed to the delivering end 53. The arm 62 is displaceable laterally along a slot 64 to adjust to the different width of book sections.

Figure 2:
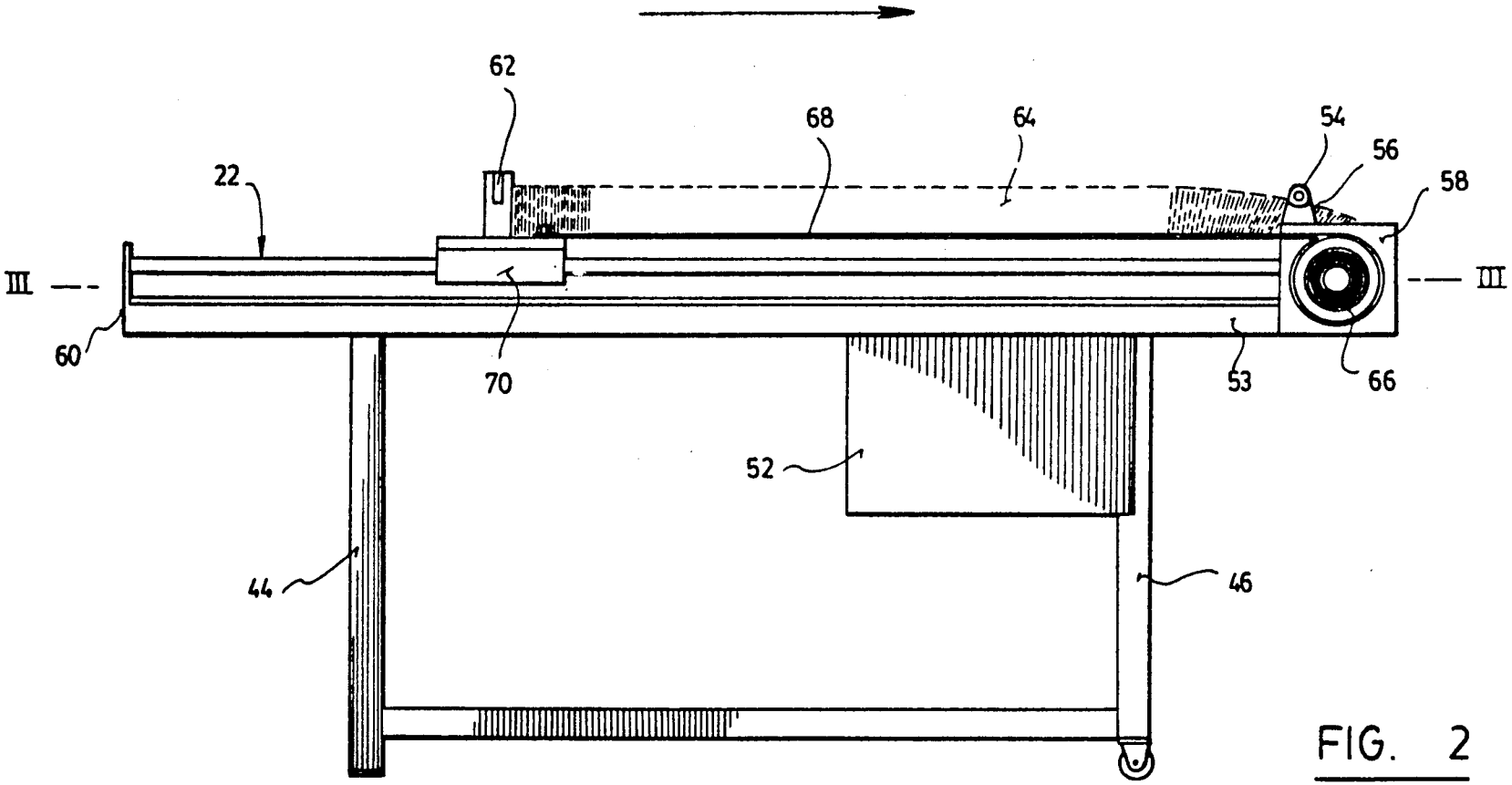
FIG. 2 is a side view of the book section feeder according to the invention.

FIG. 2 illustrates a plurality of bundles of book sections 64 being fed by the conveyor 22. It is shown particularly, the arm 62 as actuated by a spring pulley 66 via a cable 68 that pulls a holding member 70 toward the delivering end 53.

FIG. 3 further shows the motor 72 actuating the chains 24, 26, 28, and 30 via the sprocket gears 32, 34, 36, 37, 38, and 40.

Figure 4A:
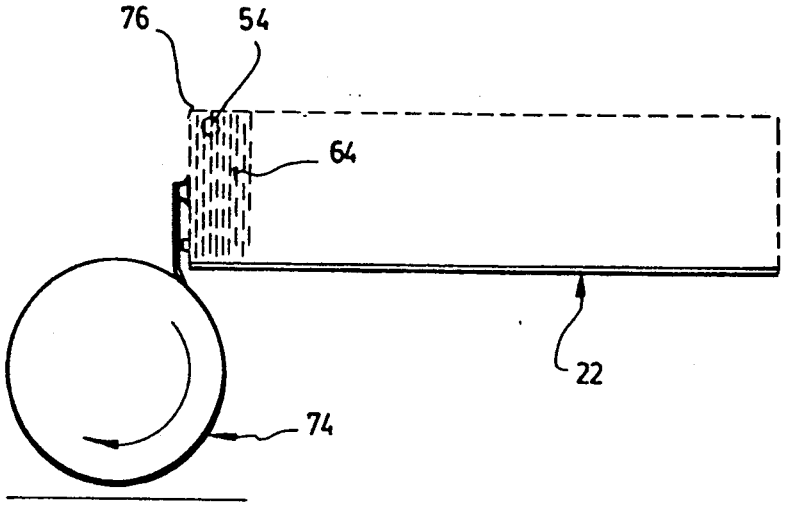
FIG. 4*a* is a detailed side view of the delivering end of the conveyor when feeding book sections to a saddle-stitching apparatus.
Figure 4B:
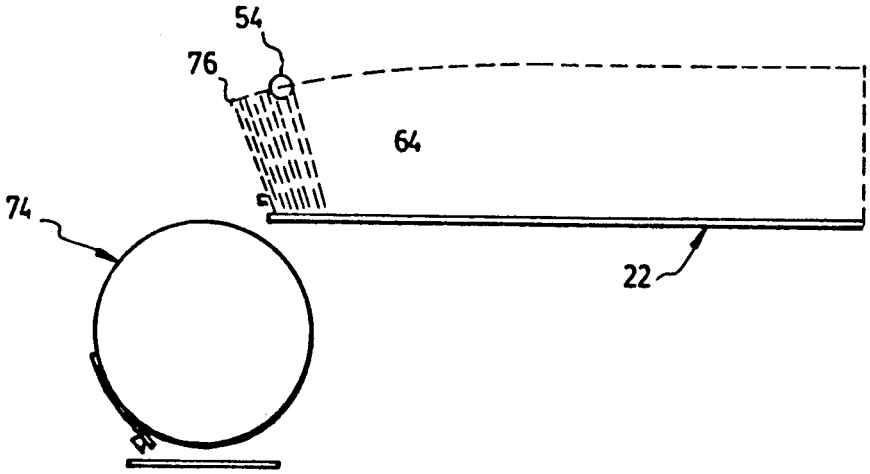
FIG. 4*b* is a detailed view as shown in FIG. 4*a* showing the detector when book sections are tilted so that the detector detects the absence of book sections.

FIG. 4*a* shows the delivering end 53 of the feeder 20 when supplying book sections 64 to a saddle-stitching apparatus 74. The detector 54 is covered by the upper margin 76 of the vertical book sections 64. As seen on FIG. 4*b*, when the number of book section 64 decreases on the conveyor, they start tilting on the side such that the detector 54 is partially uncovered. The absence of book sections in front of the detector 54 actuates the motor to drive the conveyor 22 and bring more sections 64 to the delivering end 53. Once the detector 54 is covered, the presence of book sections 64 stops the motor.

FIG. 5 shows the conveyor 22 and the chains 124, 126, 128, and 130. The book sections 64 are retained upwardly on the delivering end 53 by retaining means such as two small hooks 96 provided at the delivering end 53. The sections are held upwardly until the binding apparatus picks one book section and slides it between the conveyor 22 and the hooks 96 to take it down to be bound.

Figure 6A:
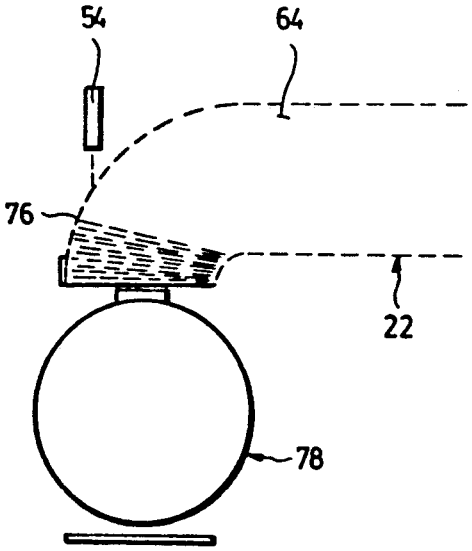
FIG. 6*a* is a detailed side view of the delivering end of the conveyor when feeding book sections to a perfect-binding apparatus.
Figure 6B:
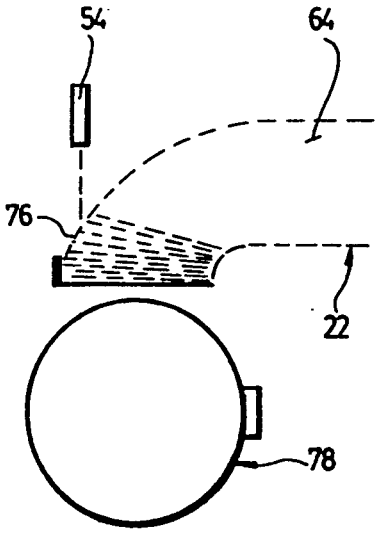
FIG. 6*b* is a detailed view as shown in FIG. 6*a* showing the detector when book sections are tilted so that the detector detects the absence of book sections.

FIG. 6*a* shows a different type of book binding apparatus being fed by a another embodiment of the book section feeder of the invention. The book section feeder 20 feeds book sections 64 to a perfect binding apparatus 78. The detector 54 is able to evaluate its distance from the upper margin of the book sections 76. As shown in FIG. 6*b*, when the book sections are titled, the distance between the detector 54 and the upper margin 76 is greater. This signal actuates the motor to drive the chains of the conveyor 22 to provide more book sections near the delivering end 53. Once the detector senses the presence of book sections 64, it stops the conveyor 22.

Of course, although a chain conveyor is preferred, it should be noted that other types of conveyors such as continuous belt conveyor could be used for the invention.

We claim:

1. A self-actuated book section filler feeder for feeding book sections to a binding apparatus wherein said book sections must be in a horizontal position to be picked up, said feeder comprising:

a table that is separate from the binding apparatus;

a continuous book section conveyor mounted on said table, said conveyor receiving and carrying book sections in a vertical position toward a delivering end, means devised to allow said books sections to tilt from a vertical to a horizontal position in order to be properly picked up;

a motor mounted on said table for driving said conveyor; and a detector mounted on said table at the delivering end of the conveyor to sense the presence or absence of a sufficient number of book sections to be fed as a function of the distance separating said detector from said tilted book sections, said detector being electrically connected to said motor for actuating said motor and thus actuating said conveyor to bring more of said book sections toward said delivering end when the number of book sections at said delivering end becomes too small and causes, due to the tilting of the sections, the distance between said book sections and the detector to become greater than a predetermined value.

2. A book section feeder as claimed in claim 1, wherein said detector includes a photoelectric cell having a downwardly oriented beam.

3. A book section feeder as claimed in claim 2, wherein said conveyor is a chain conveyor that is driven by said motor through sprocket gears connected to a variable speed reducer, and wherein said motor is actuated by said detector through a relay.

4. A book section feeder as claimed in claim 3, further comprising:

means to secure the book sections onto the conveyor, said securing means including an era advancing along with the conveyor as the book sections are conveyed to said delivering end, said arm being actuated by a spring pulley via a cable that pulls said arm toward said delivering end.

5. The book section feeder as claimed in claim 3, wherein said binding apparatus is a perfect binding apparatus.

* * * * *